United States Patent [19]

Essig et al.

[11] Patent Number: 4,713,502

[45] Date of Patent: Dec. 15, 1987

[54] CONTROLLER FOR CONTROLLING ELECTRICAL HEATERS

[75] Inventors: Willi Essig, Boeblingen; Hans Mayer, Kuernbach; Siegfried Mannuss, Sternenfels, all of Fed. Rep. of Germany

[73] Assignee: E.G.O. Elektro-Geräte Blanc u. Fischer, Fed. Rep. of Germany

[21] Appl. No.: 788,331

[22] Filed: Oct. 17, 1985

[51] Int. Cl.[4] ..... H01H 3/16

[52] U.S. Cl. ..... 200/61.82; 200/11 R; 431/254

[58] Field of Search ..... 200/61.82, 11 R, 14; 431/254, 256; 74/527

[56] References Cited

U.S. PATENT DOCUMENTS

| | | | |
|---|---|---|---|
| 4,123,633 | 10/1978 | Stevens | 200/61.86 |
| 4,136,324 | 1/1979 | Fischer | 337/139 |
| 4,206,344 | 6/1980 | Fischer | 337/99 |
| 4,371,764 | 2/1983 | Runion | 200/61.86 |

*Primary Examiner*—E. A. Goldberg
*Assistant Examiner*—Lincoln Donovan
*Attorney, Agent, or Firm*—Steele, Gould & Fried

[57] ABSTRACT

A controller has an axially releasable locking unit operable to prevent rotation of a regulating shaft from at least one locking position, without first axially moving the regulating shaft. This push-to-turn or pull-to-turn locking unit is arranged entirely outside of a housing of the controller, and is arranged with mounting particulars matched to those of the controller such that the same controller assembly can be used interchangeably either with a push-to-turn locking unit or without such a unit.

13 Claims, 6 Drawing Figures

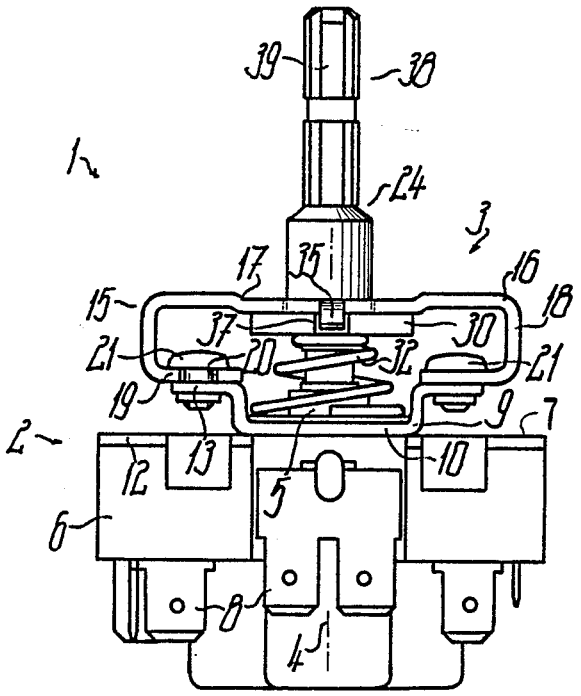
Fig.1
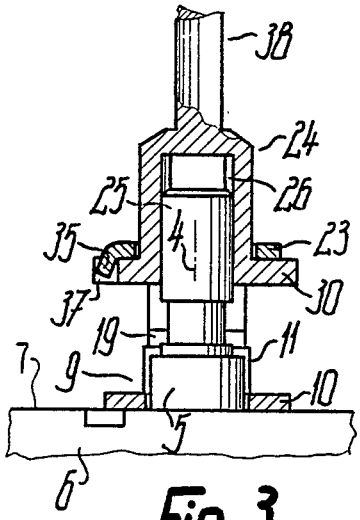
Fig.3
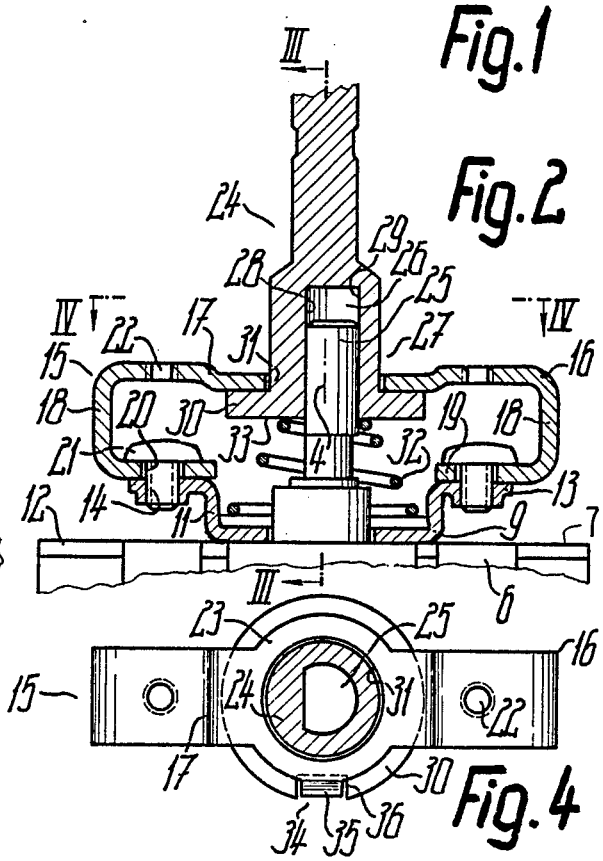
Fig.2
Fig.4

CONTROLLER FOR CONTROLLING ELECTRICAL HEATERS

The invention relates to a controller for controlling the supply of electric energy to at least one electric heater, said controller having a housing and a regulating shaft rotatable in different regulating positions about a regulating axis, said regulating shaft projecting from a front face of said housing and having a connection means for connecting said regulating shaft with a regulating handle, said controller having attachment means near the front face of said housing.

In several countries for safety purposes such controllers have to be locked in at least one position of the regulating shaft, said position usually being the switched off or zero position. Therefore, known controllers are equipped with a push-to-turn means permitting a rotation of the locked regulating shaft only after pushing this shaft by means of the handle in an axial direction. These safety means are incorporated with the controller inside of the housing. Therefore, entirely different controllers have to be manufactured to get controllers with push-to-turn means on one hand and controllers without such means on the other hand, the latter being needed very often as well, although the actual electrical switch parts as well as other parts may be the same. This leads to disadvantages in fabrication, storage of parts and repair of broken controllers, i.e. as the housings and other parts of the said two types of controllers are different in shape and dimension.

An object of the invention is to provide a controller for controlling the supply of electric energy to at least one electrical heater which is easy to manufacture on a small scale and can be equipped either with a locking means for the regulating shaft or without such a locking means.

Another object of the invention is to provide a controller of this kind which is easy to mount in its operating position, like on the switch screen or panel of a stove or the like and whose locking means may be repaired without difficulties.

Still another object of the invention is to provide means whereby a controller can be equipped with locking means for the regulating shaft even though the original controller does not have such locking means.

Still another object of the invention is to provide a controller which is relatively small, especially as far as the housing is concerned, so that the controller needs only a small space for mounting.

According to the present invention, a controller is provided for controlling the supply of electric energy to at least one electrical heater, said controller having a housing and a regulating shaft rotatable to different regulating positions about a regulating axis, said regulating shaft projecting from a front face of said housing and having connection means for connecting said regulating shaft with a regulating handle, said controller having attachment means near the front face of said housing. The device comprises slide-to-turn means having cooperating rotation stop members for locking the regulating shaft against rotation in at least one position thereof, said stop members being movable relative to each other in the direction of the regulating axis of said regulating shaft in at least two axial positions, thereby engaging the stop members in one axial locking position and disengaging the stop members in at least one other axial position for released rotation of the regulating shaft. The axial disengagement or unlocking movement may be in the one direction or the opposite direction or in both possible directions of the regulating axis so as to either unlock by pushing or pulling the handle, although a slide-to-turn means acting as a push-to-turn means will be the preferred embodiment.

Since the slide-to-turn means is mounted on the outside of the housing of the controller there is no difficulty to provide a controller, having a relatively narrow casing with just enough space for receiving the electrical switch parts with a safety locking means for the regulating shaft, without having to enlarge or adapt the shape of the housing in any manner.

In a preferred embodiment of the invention the slide-to-turn means comprises an intermediate shaft with a connection means for connecting said intermediate shaft with the regulating handle at an outer end portion, said intermediate shaft having coupling means for coupling said intermediate shaft to the connection means of the regulating shaft near another end portion of said intermediate shaft for rotation of said regulating shaft by means of said intermediate shaft. The intermediate shaft may have connection means of equal dimensions or at least adapted to the connection means of the regulating shaft, such that one and the same regulating handle may be used on either of said connection means. Furthermore, the coupling means of the intermediate shaft may be substantially of equal size or at least adapted to the corresponding fixing means of the handle, such that the original connection means of the regulating shaft may be used as the counter coupling means for coupling the regulating shaft with said coupling means of the intermediate shaft.

Although the intermediate shaft may be axially aligned with the regulating shaft, or non-aligned and coupled with the regulating shaft by means of an intermeshing gear, in a preferred embodiment of the invention the intermediate shaft directly engages said regulating shaft and is axially aligned with the latter. The intermediate shaft advantageously is mounted on the regulating shaft in such a way that these two shafts are rigidly connected one to each other in the two directions of rotation and slideably engage one another in the direction of the regulating axis, thereby permitting an arrangement in which the regulating shaft may be mounted immovably in its axial direction in relation to the housing. The intermediate shaft is then the member which is moved axially relative to the housing for locking and unlocking the slide-to-turn means.

A resilient member for urging the stop members towards the locking position may readily be positioned outside of said housing to save space inside. This resilient member can therefore have quite large dimensions providing soft spring charcteristics over the whole range of axial unlocking movement. Preferably the resilient member is a helical spring engaging said inner end portion of said intermediate shaft and resting against an outside surface of a part of said housing.

According to a further feature of the invention said intermediate shaft is slideably and rotatably held in a supporting means adapted to be attached to said housing by means of said attachment means, thereby allowing the slide-to-turn means to be attached on the rest of the controller (i.e., on the housing) without the need for any extra attachment means. Although the slide-to-turn means may be assembled by mounting the corresponding parts to the housing and the regulating shaft of the controller, in a preferred embodiment of the invention, the slide-to-turn means is a preassembled unit which may easily be mounted on the controller as a whole.

It is particularly preferable for mounting the controller in its operating position on a panel or the like to provide a secondary attachment means for attachment of the controller on the slide-to-turn means, said secondary attachment means being equal to or different than the corresponding attachment means of the housing for attaching the housing either in its operating position or to the slide-to-turn means. The whole controller therefore in operating position will be held only by means of the slide-to-turn means which in turn serves for mounting the controller housing in its operating position.

A very compact, easy to manufacture and safe functioning slide-to-turn means is provided by forming one of said stop members as a radially or axially projecting strip or tongue of said supporting means, said cooperating stop member being a cut out opening in the circumference of a flanged disc on the inner end of said intermediate shaft, said flanged disc abutting against an inner face of said supporting member in the locking position of said stop members, thereby determining the locking position of the intermediate shaft.

The invention may be used in connection with very different types of controllers, power controllers and other switch-like means, like expansion box temperature controllers for electric appliances according to U.S. Pat. No. 4,136,324 or electric power controllers according to U.S. Pat. No. 4,206,344, where further details of controller base assemblies according to this invention are thoroughly described.

BRIEF DESCRIPTION OF THE DRAWINGS

Further advantages and features of the invention will become apparent, by way of example, from the following description and the accompanying drawings showing preferred embodiments. In the drawings:

FIG. 1 is a side view of the controller according to the invention.

FIG. 2 is a central axial section through a part of the arrangement according to FIG. 1.

FIG. 3 is a section taken along the line III—III of FIG. 2.

FIG. 4 is a section taken along IV—IV in FIG. 2.

DETAILED DESCRIPTION OF THE PREFERRED EMBODIMENTS

Figure 5:
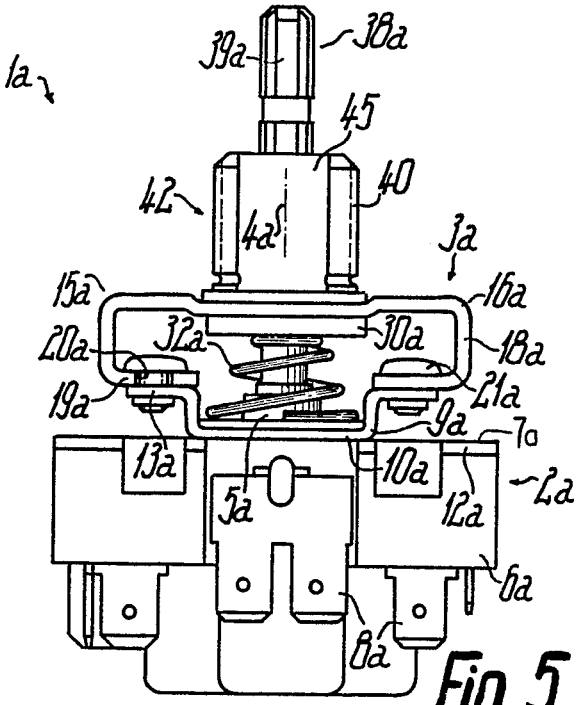
FIG. 5 is a side elevation of a second embodiment according to the invention.

The controller 1 shown in FIGS. 1 to 4 has a controller base assembly 2 and a slide-to-turn locking unit 3 fixed together separably one to another, in an aligned arrangement on a central axis 4 of a regulating shaft 5, projecting at right angle outside of a front face 7 of a housing 6, encasing the regulating and switch parts of said controller base assembly 2 in at least substantially sealed manner. The regulating shaft 5 serves, only by turning or rotating movement, to operate said regulating and switch parts between a cut off position and a position of maximum supply of electric energy over a range of different regulating positions. On the rear side of the housing 6 plug lugs 8 project to the rear for electrical connection of the controller to supply lines. On the front face 7 of the housing 6 there is fixed a flange member 9, having a base plate lying against the front face 7, the base plate having a central bore for receiving a part of the regulating shaft adjacent the front face 7. On two opposite edges the base plate 10 is provided with upstanding plate legs 11, projecting almost at right angles from the front face 7 and being arranged symmetrically around a plane of the axis 4. The width of the plate legs 11 is remarkably smaller than the corresponding width of the base plate 10 and these legs 11 are formed by bending projections of the corresponding edges of the base plate 10. The flange member 9 itself may be mounted to the corresponding wall of the housing 6 by means of legs (not shown) bent in the opposite direction compared to legs 11 and arranged on the edges at angles thereto, these legs projecting through openings of wall of the housing 6 and secured thereto by rivetlike deformation. The wall of the housing 6 may be a detachable plate-like cover 12, closing the receiving opening of the housing 6 for receiving the regulating and switch parts on the entire width of the housing 6 and being detachable from said housing 6 and the regulating shaft 5 as a unit, which is preassembled with the slide-to-turn locking unit 3. The legs 11 extend on their outer ends into oppositely directed mounting flanges 13, lying in one plane perpendicular to the axis 4 and each having at least one threaded bore 14 arranged in the vicinity of its center.

The slide-to-turn locking unit 3 is provided with a base and mounting means forming a supporting means 15 adapted to be fixedly but preferably detachably attached to the mounting flanges 13 thereby engaging the controller base assembly 2 through connection to the mounting flanges 13. The supporting means 15 is made from one single piece and formed by a metallic flat strip generally bent into a C-shape. Thereby the strip 16, having constant width almost over its entire length forms a central cross piece 17, legs 18 projecting at angles from the ends of the cross piece 17 towards said housing 6 and flange ends 19 projecting towards each other from the ends of the legs 18 opposite to the cross piece 17, said flange ends 19 being arranged in a common plane and at a distance from one another greater than the largest diameter of the regulating shaft 5 and about the same as the distance between the plate legs 11. Each flange end 19 is provided with a through bore 20 for receiving a fixing means 21, for example a bolt, a screw threaded into the threaded bore 14, a rivet or the like. Especially in the case where screws are used for detachably fixing the supporting means 15 to the mounting flanges 13 the openings 22 are provided in the cross piece 17, these openings 22 being aligned with the through bores 20 for access to the heads of the screws by means of a tool such as a screwdriver. One of the through bores 20 is open over almost its entire width to a lateral margin of the corresponding flange end 19 thereby forming a lateral inserting opening for the corresponding fixing bolt 21. The slide-to-turn means 3 may be mounted to the cover 12 before mounting the latter to the housing 6 or before inserting the regulating shaft 5 through a closeable opening at the rear side of the housing 6, whereby first one of the fixing bolts 21 will be inserted through the corresponding openings of one flange end 19 and one mounting flange 13 and one fixing bolt 21 will be loosely inserted into the receiving opening of the other mounting flange 13; after this the supporting means 15 may be swung around the axis of the first mentioned fixing bolts 21 in such direction, that the laterally open through bore 20 will receive the shaft of the corresponding fixing bolts 21 in a movement almost rectangular to the axis thereof. After tightening the fixing bolts 21 the so formed preassembled unit may be assembled with the remaining parts of the controller 1.

A central, almost ring-shaped part of the cross piece 17 of the supporting means 15 provides a bearing plate 23 for an intermediate shaft 24, said bearing plate being coaxial to the axis 4 and arranged in a plane perpendicular to the axis 4, nearer to the flange ends 19 than the adjacent parts of the cross piece 17, the amount of the difference of these distances being about equal to or less than the thickness of the material the strip 16 is bent from.

Figure 6:
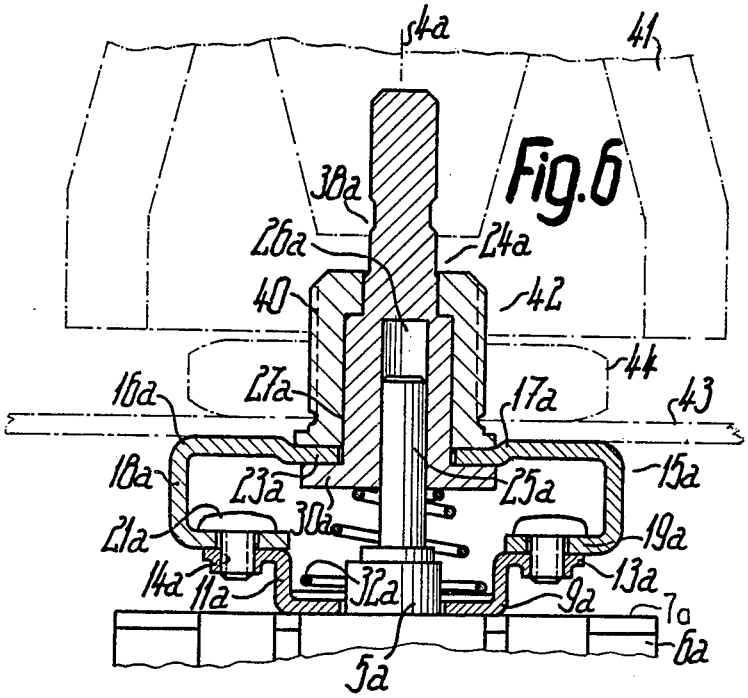
FIG. 6 is an axial section through the slide-to-turn means of the embodiment according to FIG. 5.

The free end of the regulating shaft 5, having a smaller diameter than the part of the shaft projecting through the flange member 9 forms a connection means 25 for connecting the regulating shaft 5 with a regulating handle shown by dash-dot lines in FIG. 6 in those cases where the controller is used without a slide-to-turn locking unit 3. In the case shown in the drawings, where a slide-to-turn locking unit 3 is operationally connected to the controller 1, the same connection means 25 serves as a counter coupling means for coupling the regulating shaft 5 with a coupling means 26 formed by the inner end portion 27 of the intermediate shaft 24, said inner end portion 27 being the portion of the intermediate shaft 24 which is nearest to the housing 6. For providing the connection means 25 the cylindrical end portion of the regulating shaft 5 has a longitudinal planar surface 28 extending parallel to a plane of the axis 4 and arranged on the circumference of the said end portion of the regulating shaft 5. For providing the counter coupling means 26 the intermediate shaft 24 has an opening 29 in its inner end portion 27, said opening 29 being of almost the same cross section as the connection means 25 thereby receiving this connection means 25 in an axially slideable manner but not permitting relative rotation of the two shafts 5, 24. On the inside of the bearing plate 23 facing towards the housing 6 the intermediate shaft 24 forms an enlarged flange disc 30, having a larger diameter than the bearing plate 23. Adjacent to this flange disc 30 a cylindrical part of the inner end portion 27 of the intermediate shaft 24 projects through a bearing hole 31 in the bearing plate 23 thereby allowing the intermediate shaft 24 to move in an axial direction relative to the supporting means 15, but being held against a radial movement. A resilient member 32 formed by a helical spring having a generally conical shape is arranged between the base plate 10 and the inner end face 33 of the flange disc 30 around the regulating shaft 5. The resilient member 32 rests with its end of larger diameter between the plate legs 11 against the base plate 10.

On its circumference the bearing plate 23 is provided with a stop member 34 arranged almost symmetrical to a plane of the axis 4 perpendicular to the central corresponding longitudinal plane of the strip 16. The stop member 34 is formed by a tongue 35 bent from the edge of the bearing plate in a direction towards the housing 6 and arranged at a sloping angle in such a way that tongue 35 projects radially outwardly toward its free end. The cooperating stop member 36 for the stop member 34 is formed by the lateral parallel margins of a cut out opening in the cylindrical outer edge of the flange disc 30. In locking position, whereby the intermediate shaft 24 by means of the resilient member 32 is abuts with its ring-like shoulder against the inner surface of the bearing plate 23, the tongue 35 projects into the cut out opening 37 under the condition that the two corresponding stop members are aligned in an axial position, thereby preventing the regulating shaft 5 from being turned by means of the intermediate shaft 24 around the axis 4. For turning the regulating shaft 5 it is necessary to first push the intermediate shaft 24 against the resilient member 32 towards the housing 6 thereby disengaging the stop members 34, 36 and allowing free rotation of the regulating shaft 5 by means of the intermediate shaft 24. While turning further, the intermediate shaft 24 will not have to be held in a pushed in position since the end of tongue 35 will easily slide on the ring-shaped outer shoulder of flange disc 30, even if the spring force of resilient member 32 is relatively high. As soon as stop member 36 arrives again at an aligned position with tongue 35 the resilient member 32 will urge the intermediate shaft 24 back into locking position. The axial extension of stop member 34 is very small and is comparable to the size of the thickness of strip 16, the stop member 34 lying entirely inside the cut out opening 37 in locking position and not projecting beyond the outside of flange disc 30. In pushed-in position the intermediate shaft 24 with the inside end face of opening 29 abuts against the end face of connection means 25 thereby preventing the flange disc 30 from pressing the resilient member 32 more than just necessary for disengaging the stop members 34, 36.

Openings 22 may be threaded bores of exactly the same thread size as threaded bores 14 whereby the controller can be attached in operating position by threaded bolts engaging the openings 22. Since openings 22 are the same distance apart as the threaded bores 14, the same counter openings in the screen panel of a stove or the like may be used whether the controller 1 is equipped with a slide-to turn locking unit 3 or not.

The outer end portion 38 of intermediate shaft 24 is reduced in diameter relative to the inner end portion 27 and forms a connection means 39 adapted for attachment of the same setting or regulating button which would have been used directly on the regulating shaft 5 if the slide-to-turn locking unit 3 was not provided.

In FIGS. 5 to 6 corresponding parts have the same numerals as in FIGS. 1 to 4, the numerals in FIGS. 5 and 6 having added the index "a". The controller **1*a* shown in FIGS. 5 and 6 comprises a threaded nut 40 forming the attachment means 42 for attaching the controller 1*a* in its operating position. The threaded nut 40 is fixedly attached to the part of the supporting means 15 by welding or soldering its inner end face against the outside face of bearing plate 23 coaxially to axis 4*a*. The hollow nut receives and bears the inner end portion 27*a* of intermediate shaft 24, whose outer, reduced end portion 38*a* projects through a narrow bore part of nut 40. Nut 40 is provided on the outside with a thread adapted to be engaged by a threaded nut after inserting nut 40 through a bolt in a mounting plate 43 thereby tightening the mounting plate 43 between the outer surfaces of cross piece 17 adjacent to bearing plate 23*a* and the threaded nut 44. For preventing rotation of the controller 1*a* relative to mounting plate 43 nut 40 is provided with a planar surface on its circumference, this surface 45 cooperating with a corresponding edge of the bore in mounting plate 43. Mounting plate 43 and threaded nut 44 are shown in dash-dot lines in FIG. 6. The outer end portion 38*a* of intermediate shaft 24*a* is provided with the detachable handle means 41**.

The slide to turn means according to the invention may be used with all types of controllers, like regulators, controllers controlled via capillary tube systems, switches and the like, which have the described attachment means and a regulating shaft.

We claim:

1. An attachment for a controller for controlling supply of electric energy to at least one electrical heating element, said controller having a housing for an electrical controlling means and a regulating shaft rotatable to different regulating positions about a regulating axis, said regulating shaft projecting from a front face of said housing and having connection means adapted for directly connecting said regulating shaft with a regulating handle, said attachment means located near the front face of said housing, comprising:

slide-to-turn means mounted on an outside of said housing in a vicinity of the front face, said slide-to-turn having cooperating rotation stop members disposed at a distance from said housing, said stop members being engagable to lock the regulating shaft against rotation in at least one position thereof, and disengagable to release said regulating shaft for rotation by a disengaging axial slide movement of said stop members relative to one another, said stop members being movable relative to one another in a direction parallel to the regulating axis of said regulating shaft in at least two relative axial positions, thereby engaging the stop members in one axial locking position whereupon the regulating shaft is locked against rotation, and disengaging the stop members in another axial position, thereby releasing the regulating shaft for rotation, said slide-to-turn means having an intermediate shaft with a coupling means engagable on the regulating shaft in place of the regulating handle.

2. An attachment for a controller according to claim 1, wherein the intermediate shaft has a connection means operable to connect said intermediate shaft with the regulating handle at an outer end portion of the intermediate shaft, said coupling means being disposed on an inner end portion of the intermediate shaft.

3. An attachment for a controller according to claim 2, wherein said intermediate shaft directly engages on said regulating shaft.

4. An attachment for a controller according to claim 2, wherein said intermediate shaft is mounted coaxially to said regulating shaft, said intermediate shaft having an opening in the inner end portion for slidably receiving the connection means of said regulating shaft, the opening being aligned to the regulating axis, whereby the intermediate shaft remains coaxial with the regulating shaft.

5. An attachment for a controller according to claim 1, further comprising a resilient member urging said stop members towards the axial locking position along the regulating axis.

6. An attachment for a controller according to claim 5, wherein the resilient member is a spring mounted around the regulating shaft outside of said housing and engaging said inner end portion of said intermediate shaft, thereby forming a push-to-turn means disengagable by pushing the intermediate shaft toward the housing.

7. An attachment for a controller according to claim 2, further comprising a supporting means and wherein said intermediate shaft is slidably and rotatably held in the supporting means, the supporting means being adapted to be attached to said housing by means of said attachment means, said supporting means and the intermediate shaft forming a preassembled unit.

8. An attachment for a controller according to claim 7, wherein said supporting means is a C-shaped supporting body having two opposed end portions and a cross piece opposite said opposed end portions, the end portions of the supporting body being attached to a flange member of said housing and the cross piece bearing the intermediate shaft in a bearing hole therein.

9. An attachment for a controller according to claim 7, wherein the supporting means further comprises a secondary attachment means for attachment of the controller to a panel via said supporting means.

10. An attachment for a controller according to claim 9, wherein the secondary attachment means is a threaded nut threadable on the intermediate shaft on a side of said cross piece opposite to said housing and the threaded nut being attached to said supporting means.

11. An attachment for a controller according to claim 7, wherein one of said stop members is a radially projecting tongue of said supporting means, bent in an axial direction toward said housing, another of said stop members cooperating with said one of said stop members being a cut out opening in a circumference of a flanged disc on the inner end of said intermediate shaft, said flanged disc abutting against an inner face of said supporting member in the locking position of said stop members.

12. An attachment for a controller according to claim 9, wherein the supporting means and the secondary attachment means are equally dimensioned, whereby said slide-to-turn means and said housing are interchangeably attachable to the panel.

13. An attachment for a controller according to claim 12, wherein the attachment means and the secondary attachment means include spaced means for receiving fasteners adapted to be passed through the panel.

* * * * *